United States Patent [19]

Bono

[11] Patent Number: 4,713,845

[45] Date of Patent: Dec. 22, 1987

[54] TOILET SEAT DISENFECTING DEVICE

[76] Inventor: Salvatore A. Bono, 885 Manor La., Bayshore, N.Y. 11706

[21] Appl. No.: 931,554

[22] Filed: Nov. 17, 1986

[51] Int. Cl.[4] ..... A47K 13/00

[52] U.S. Cl. ..... 4/233

[58] Field of Search ..... 4/233, 237, 222; 15/246

[56] References Cited

U.S. PATENT DOCUMENTS

| | | | |
|---|---|---|---|
| 3,599,246 | 8/1971 | Bramati | 4/233 |
| 3,837,018 | 9/1974 | Haberle | 4/233 |

FOREIGN PATENT DOCUMENTS

| | | | |
|---|---|---|---|
| 52034 | 10/1911 | Austria | 4/233 |
| 510241 | 10/1930 | Fed. Rep. of Germany | 4/233 |
| 12200 | of 1906 | United Kingdom | 4/233 |

*Primary Examiner*—Henry J. Recla
*Assistant Examiner*—L. J. Peters
*Attorney, Agent, or Firm*—Michael I. Kroll

[57] ABSTRACT

A toilet seat disenfecting device is provided that is slideably affixed to underside of a toilet seat cover so that when the cover is down the device can be manually pulled around perimeter of a toilet seat to disenfect it.

6 Claims, 6 Drawing Figures

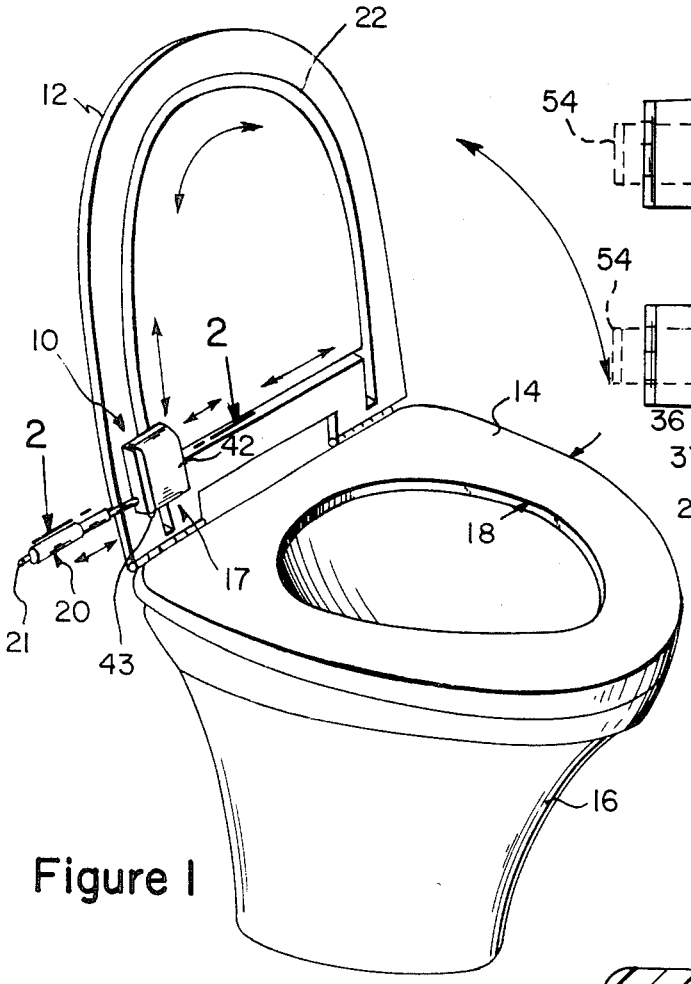
Figure 1
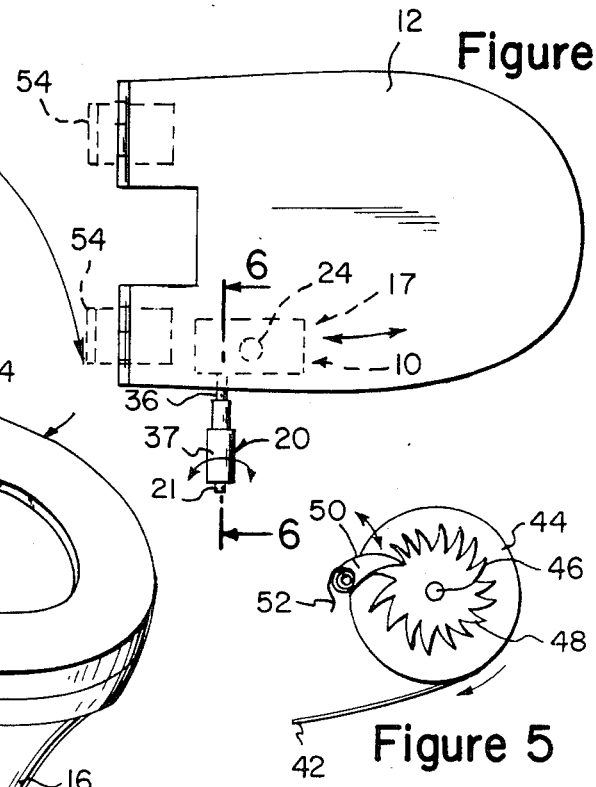
Figure 4
Figure 5
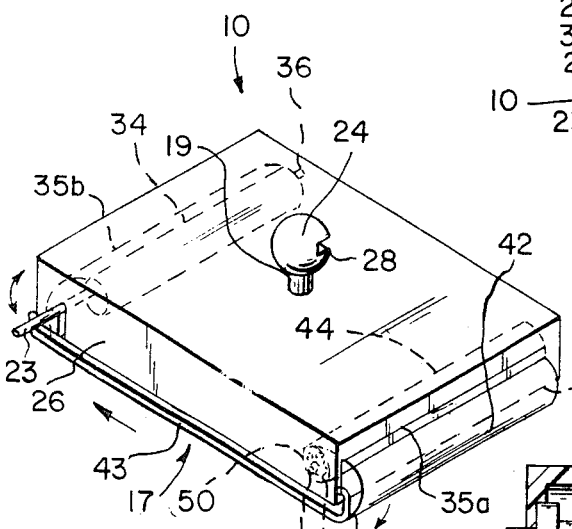
Figure 3
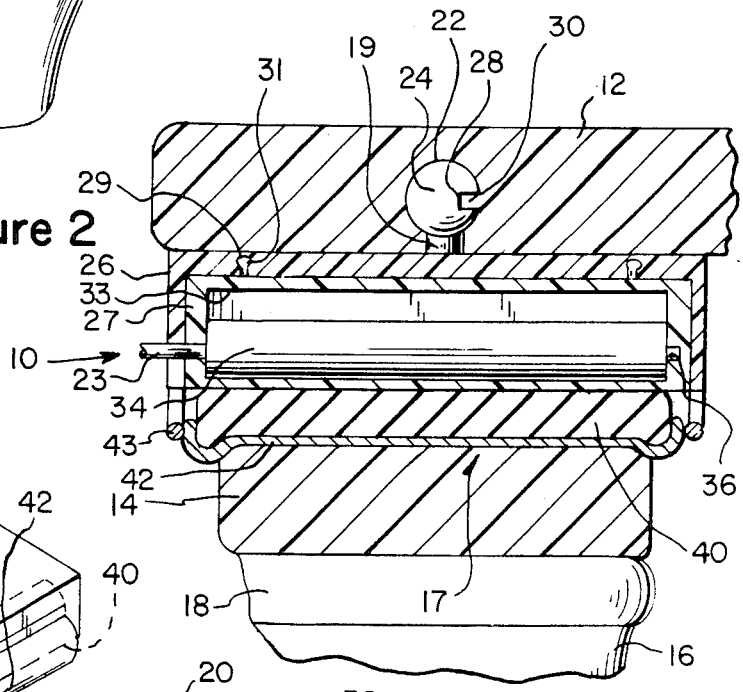
Figure 2
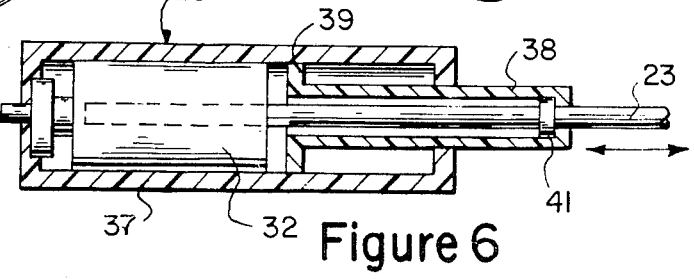
Figure 6

TOILET SEAT DISENFECTING DEVICE

BACKGROUND OF THE INVENTION

1. Field of the Invention

The instant invention relates generally to hygienic toilet seats and more specifically it relates to a toilet seat disenfecting device.

2. Description of the Prior Art

Numerous hygienic toilet seats have been provided in prior art that are adapted to contain mechanisms built within to keep the toilet seats clean and sanitary. For example, U.S. Pat. Nos. 4,213,212 and 4,536,899 are illustrative of such prior art. While these units may be suitable for the particular purpose to which they address, they would not be as suitable for the purposes of the present invention as heretofore described.

SUMMARY OF THE INVENTION

A primary object of the present invention is to provide a toilet seat disenfecting device that will overcome the shortcomings of the prior art devices.

Another object is to provide a toilet seat disenfecting device that is slideably affixed to underside of toilet seat cover so that when the cover is down the device can be manually pulled around perimeter of toilet seat to disenfect it.

An additional object is to provide a toilet seat disenfecting device that includes a portion which can be quickly disassemblied therefrom so that the disenfecting material being a roll of alcohol impregnated tissue which can be replaced when needed.

A further object is to provide a toilet seat disenfecting device that is simple and easy to use.

A still further object is to provide a toilet seat disenfecting device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a perspective view of a toilet bowl with the invention being a disenfecting device slideably mounted to underside of an opened toilet seat cover.

FIG. 2 is an enlarged cross sectional view taken along line 2—2 in FIG. 1 with the cover closed.

FIG. 3 is an enlarged perspective view of the disenfecting device removed from the cover.

FIG. 4 is a top view of the cover with the disenfecting device therebelow.

FIG. 5 is a detail view of a ratchet wheel and pawl which allows a roll of fresh disenfected tissue to turn in only one direction.

FIG. 6 is an enlarged cross sectional view taken along line 6—6 in FIG. 4 showing the electronic controlled telescopic handle in greater detail.

DETAILED DESCRIPTION OF THE PREFERRED EMBODIMENTS

Turning now descriptively to the drawings, in which similar reference characters denote similar elements throughout the several views, FIGS. 1 through 4 illustrates a disenfecting device 10 for a toilet seat 14 that has a hinged cover 12 with the toilet seat being hinge mounted to a toilet bowl 16. The device 10 consists of a recepticle 26 being of a size to cover width 18 of the toilet seat 14. The recepticle 26 is mounted to underside of the cover 12 so as to slideably travel around perimeter of the cover when the recepticle is manually manipulated. A mechanism 17 for disenfecting the toilet seat 14 is mounted within the recepticle 26 and extends outwardly therefrom so as to make contact with the toilet seat when the cover 12 is in a closed position over the toilet seat 14.

The cover 12 has a track 22 extending around the perimeter of the underside thereof. A follower 19 extends upwardly from center of the recepticle 26 to engage with the track 22. The track has a tongue member 30 extending inwardly from one side thereof. The follower 19 has a ball member 24 at remote end thereof. The ball member has a groove 28 extending inwardly so as to receive the tongue member 30 in the track 22 to properly position the recepticle 26 and prevent removal of the recepticle from underside of the cover 12.

The disenfecting mechanism 17 includes a casing 27 being of a size to removably fit within the recepticle 26. The casing 17 has a hollow chamber 33 and a pair of slots 35*a*, 35*b*. Each slot is at an opposite end of the casing 27. A pair of reels 44, 34 are provided in which each is positioned within the hollow chamber 33 at opposite ends of the casing 17 and rotatably mounted to side walls thereof. A rubber pad 40 is mounted to underside of the casing 27. An elongated disenfecting sheet 42 is stored on the first reel 44 at forward end of the casing. The sheet 42 extends outwardly from the first slot 35*a* around the rubber pad 40, into the second slot 35*b* and onto second reel 34 at rearward end to act as a wind up reel.

The recepticle 26 has female sockets 31, while the casing 27 has male snap members 29 to mate with the female sockets 31 so as to make the casing disengagably connect with the recepticle 26.

FIG. 5 shows in greater detail a ratchet wheel 48 mounted on shaft 46 of the first reel 44 and a pawl 50 pivotly mounted to one of the side walls of the casing 27 adjacent the ratchet wheel 48. A spring 52 is used for biasing the pawl 50 against the ratchet wheel 48 so that the ratchet wheel can only turn one way allowing the first reel 44 to release the disenfecting sheet 42 therefrom.

As best seen in FIGS. 2 and 3 a pair of elongated C-shaped retainer rods 43 are provided, in which each is connected to one side and extending downwardly from the recepticle 26 so as to hold edges of the elongated disenfecting sheet 42 to prevent edges of the disenfecting sheet from bending and tearing.

As best seen in FIG. 6 the device 10 further includes an electronic controlled telescopic handle 20 that consists of an elongated rod 23 extending outwardly from shaft 36 of the second wind up reel 34. A stop member 41 is mounted onto the rod 23. An inner sleeve 38 that has an annular flange 39 at one end is slideably mounted over the rod 23 in which the stop member 41 will contact end of the sleeve 38 opposite the flange 39. An outer sleeve 37 is slideably mounted over the inner sleeve 38 in which the flange 29 will contact one end of the outer sleeve 37. A solenoid 32 is secured within the outer sleeve 37 for operating the rod 23. A push button switch 21 is mounted in other end of the outer sleeve 37 and is electrically connected to the solenoid 32 for controlling the telescopic handle 20, so that the handle can be used to turn the take up reel 44 and also manually manipulate the device 10 with respect to the track 22 in the cover 12.

As shown in FIG. 4 the device 10 further contains a pair of C-shaped brackets 54 connected to rear of the toilet bowl 16 behind the hinged cover 12 to allow the cover to rest in a parallel position with respect to the toilet seat 14 so that device 10 may be operated properly.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A disinfecting device for a toilet seat having a hinged cover with the toilet seat being hinge mounted to a toilet bowl, said device comprising:

(a) a toilet seat cover (b) a receptacle being of a size to cover rim width of the toilet seat;

(c) means for mounting said receptacle to underside of the cover so as to slidably travel around perimeter of the cover when said receptacle is manually manipulated, the cover having a track extending around the perimter of the underside thereof, said mounting means including a follower extending upwardly from center of said receptacle to engage with said track, said track having a tongue member extending inwardly from one side thereof, said follower having a ball member at remote end thereof, said ball member having a groove extending inwardly so as to receive said tongue member in said track to properly position said receptacle and prevent removal of said receptacle from underside of the cover; and (d) means for disenfecting the toilet seat, said means mounted with said receptacle and extends outwardly therefrom so as to make contact with the toilet seat when the cover is in a closed position over the toilet seat, said disenfecting means including a casing being of a size to removably fit within said receptacle, said casing having a hollow chamber and a pair of slots, each said slot at opposite ends of said casing, said disinfecting means further including a pair of reels each of which is positioned within said hollow chamber at said opposite ends of said casing and rotatably mounted to side walls thereof, a rubber pad mounted to underside of said casing, and an elongated disinfectant sheet stored on first of said reels at forward end of said casing, extending outwardly from said first slot around said rubber pad, into second slot and onto second of said reels at rearward end, to act as a wind up reel.

2. A disenfecting device as recited in claim 1, further comprising:

(a) said recepticle having at least one female socket; and (b) said casing having at least one male snap member to mate within said at least one female socket so as to make said casing disengagably connect with said recepticle.

3. A disenfecting device as recited in claim 2, further comprising:

(a) a racket wheel mounted on shaft of said first reel;

(b) a pawl pivotly mounted to one of said side walls of said casing adjacent said racket wheel; and (c) a spring for biasing said pawl against said racket wheel so that said racket wheel can only turn one way allowing said first reel to release said disenfecting sheet therefrom.

4. A disenfecting device as recited in claim 3, further comprising a pair of elongated C-shaped retainer rods, each connected to one side and extending downwardly from said recepticle so as to hold edges of said elongated disenfecting sheet to prevent edges of said disenfecting sheet from bending and tearing.

5. A disenfecting device as recited in claim 4, further including an electronic controlled telescopic handle comprising:

(a) an elongated rod extending outwardly from shaft of said second wind up reel;

(b) a stop member mounted onto said rod;

(c) an inner sleeve having an annular flange at one end, said sleeve slideably mounted over said rod in which said stop member will contact end of said sleeve opposite said flange;

(d) an outer sleeve slideably mounted over said inner sleeve in which said flange will contact one end of said outer sleeve;

(e) a solenoid secured within said outer sleeve for operating said rod; and (f) a push button switch mounted in other end of said outer sleeve and electrically connected to said solenoid for controlling said telescopic handle so that said handle can be used to turn said take up reel and also manually manipulate said device with respect to said track in the cover.

6. A disenfecting device as recited in claim 5, further comprising a pair of C-shaped brackets connected to rear of said toilet bowl behind the hinged cover to allow said cover to rest in a parallel position with respect to the toilet seat, so that said device can be operated properly.

* * * * *